US005087912A

United States Patent [19]

Horwitz

[11] Patent Number: 5,087,912

[45] Date of Patent: Feb. 11, 1992

[54] UNIVERSAL PRESSURE MEASUREMENT INTERFACE

[75] Inventor: Daniel Horwitz, Altamonte Springs, Fla.

[73] Assignee: Westinghouse Electric Corp., Pittsburgh, Pa.

[21] Appl. No.: 472,746

[22] Filed: Jan. 31, 1990

[51] Int. Cl.[5] ..... G08C 19/02

[52] U.S. Cl. ..... 340/870.390; 340/870.11; 340/870.07; 307/24; 307/150; 363/52

[58] Field of Search ..... 340/870.06, 870.11, 340/870.16, 870.39, 870.30, 870.07; 73/862.04, 862.07, 112, 115; 307/118, 24, 52, 53, 125, 126, 128, 140, 150; 363/52, 53, 87, 89; 341/174

[56] References Cited

U.S. PATENT DOCUMENTS 2,935,740 5/1960 Sperry ..... 340/870.11

4,703,326 10/1987 Ding et al. ..... 340/870.11

*Primary Examiner*—Donald J. Yusko

*Assistant Examiner*—Michael Horabik

[57] ABSTRACT

A universal pressure measurement interface ("UPMI") according to the invention enables interfacing of a multiplicity of pressure transmitters to a data acquisition system. The UPMI provides the necessary DC power and signal flow for field test measurements and is suitable for direct application in various sites with line voltage of from 100 to 240 VAC at 50–60 Hz.

11 Claims, 2 Drawing Sheets

UNIVERSAL PRESSURE MEASUREMENT INTERFACE

FIELD OF THE INVENTION

The present invention relates generally to the field of measurement systems. More particularly, the invention relates to systems for measuring pressures, for example, in a turbine power plant. Still more particularly, the invention provides a universal interface between one or more field test pressure transmitters and a field test data acquisition system.

BACKGROUND OF THE INVENTION

It is often necessary to make field tests of the pressure at various points within a turbine-powered generating system. For this purpose, pressure transducers (or "pressure transmitters") are often installed on the turbine and around the turbine power plant at specific locations, depending upon where pressure measurements are needed. The pressure transducers provide voltage signals indicative of the measured pressure. Means are generally provided external to the turbine for coupling the transducers, via a cable, to a data acquisition unit which is capable of receiving and processing the pressure signals. Typically, the pressure signals are in the range of 0.2–1.0 VDC.

The transducers typically require an input voltage of approximately 24 VDC to operate, but they will generally continue to function when the input voltage varies from approximately 15 to 30 VDC. The input power to the pressure transmitters is obtained by transforming and rectifying the nearest available source of line power. For this purpose, it is generally necessary for the individual conducting the field test to bring along a portable DC power supply. The power supply must of course be compatible with the available line power. For example, a field test conducted on a turbine generator located in Spain would require a power supply capable of converting 220 to 240 VAC at 50 Hz to 24 VDC, while a field test on a turbine generator located in the United States would require a power supply capable of converting 110 to 120 VAC at 60 Hz to 24 VDC. Power supply modules are known in the art that are capable of being easily adapted to function off of any of the above conditions. These devices can become burdensome and expensive, however, particularly when it is desired that many pressure transmitters be powered at once. For example, in some systems it is necessary to simultaneously measure the pressure at up to twenty-five points.

It would therefore be desirable to provide means for providing DC power to a plurality of transducers or like elements, such as pressure transmitters. The power supply will preferably be capable of easy adaptation to line power supplies of 110–120 VAC or 220 to 240 VAC, at either 50 or 60 Hz. Most preferably, the power supply will be built into a universal interface apparatus wherein means are provided for receiving pressure data from the plurality of pressure transmitters and providing this data to a data acquisition unit over a single multi-conductor cable. Such an apparatus would reduce the amount of equipment required for field performance testing of turbines, with an attendant saving of cost, manpower, and time. The present invention achieves these goals.

SUMMARY OF THE INVENTION

According to a preferred embodiment of the invention, a universal pressure measurement interface ("UPMI") between one or more DC powered pressure transmitters and a data acquisition system is provided. Although the invention is discussed herein with reference to "pressure transmitters," the invention is equally applicable to other types of transducers, for example, temperature transducers. The UPMI comprises the following:

(a) at least one multi-pin connection for coupling signals between a multi-wire coupled to the transmitter cable and the pressure measurement interface;

(b) master pin connector means for coupling signals between the UPMI and the data acquisition system;

(c) a power entry module for receiving an input power signal of approximately 100 to 240 VAC and 50 to 60 Hz;

(d) power supply means for converting the input power to a predefined DC voltage, the DC voltage depending upon the power requirements of the pressure transmitter; and (e) means for coupling the DC voltage to the multi-pin connector, thereby providing means for supplying DC power to the pressure transmitter.

DETAILED DESCRIPTION OF PREFERRED EMBODIMENT

Figure 1:
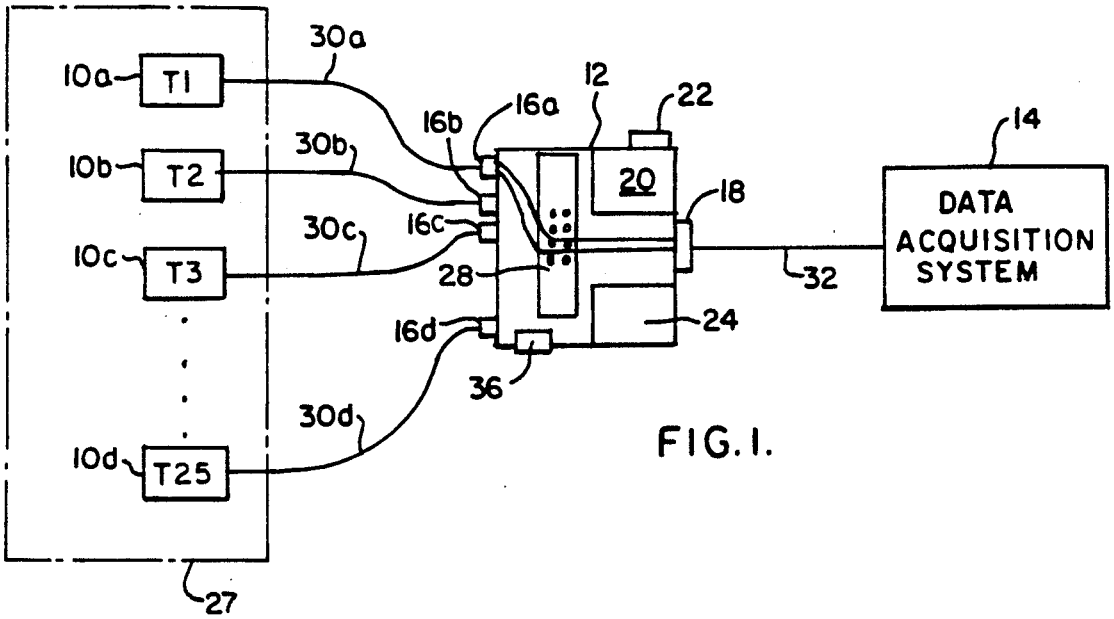
FIG. 1 is a block diagram representing a field test measurement system according to the invention.

A preferred embodiment of the invention will now be discussed with reference to the figures, wherein like reference numerals represent like elements.

Referring now to FIG. 1, therein is depicted a field test measurement system employing a UPMI 12 in accordance with the present invention. According to the preferred embodiment of the invention, a number of pressure transmitters 10*a*, 10*b*, 10*c*, etc. are coupled to a UPMI 12 via respective transmitter cables 30*a*, 30*b*, 30*c*, etc. The transducers are illustrated as being installed in a turbine power plant system 27. In the preferred embodiment, up to twenty-five pressure transmitters 10*a*, 10*b*, 10*c*, etc. can be simultaneously coupled to a single UPMI 12. Also in the preferred embodiment, transmitter cables 30*a*, 30*b*, 30*c*, etc. each comprise four conductors. Two of the four conductors carry pressure signals (0.2 to 1.0 VDC) from the pressure transmitters to the UPMI, and the remaining two conductors carry DC power from the UPMI 12 to the respective pressure transmitters 10*a*, 10*b*, 10*c*, etc.

Figure 2C:
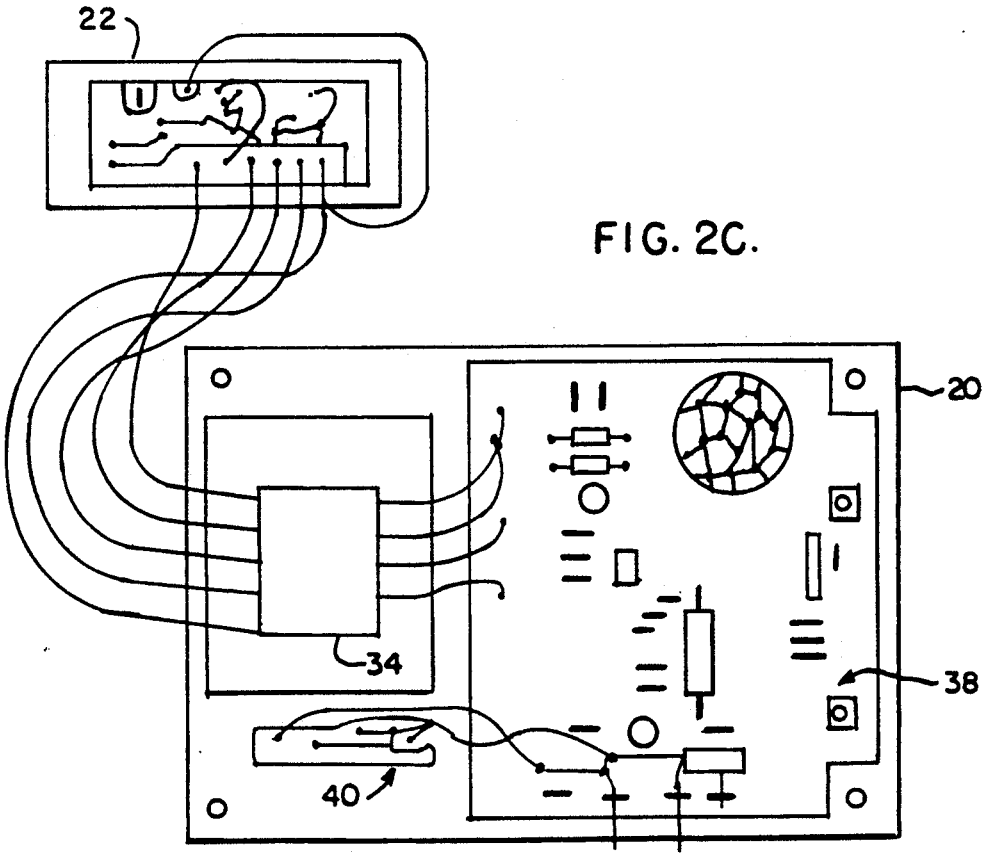
FIG. 2C is a simplified wiring diagram showing the interconnection of the power supply and power entry module of the UPMI of the present invention.

The DC power is provided by power supply 20 operating cooperatively with an externally mounted Power Entry Module 22. Power Entry Module 22 will preferably be in the form of a printed circuit board. These devices are known in the art and will therefore not be discussed in detail. It will be sufficient for an understanding of the present invention to say that Power Entry Module 22 may be repositioned on the outside of UPMI 12, depending upon the input line voltage. For example, if the line voltage is 240 VAC, Power Entry Module 22 is slid, by the user, into a first position. This first position causes the input line power to be coupled to a first pair of terminals of transformer 34 (FIG. 2*c*). This first pair of terminals is selected so that the 240 VAC input line power is converted to 24 VDC by power supply 20. Similarly, by moving Power Entry Module 22 to a second position, a line voltage of 110 VAC is converted by power supply 20 to 24 VDC. The exact construction and wiring details of power supply 20 and Power Entry Module 22 will be apparent to those skilled in the art. In addition to its convenience and flexibility, a further advantage of incorporating Power Entry Module 22 into UPMI 12 is that it may be locked into position to deter unauthorized individuals bent on tampering with the field tests. This prevents the unfortunate situation, as has happened in the past, where a pressure transmitter and/or power supply has been destroyed when a 240 VAC line voltage has been applied to a power supply designed for 110 VAC.

The preferred embodiment of UPMI 12 provides means for monitoring the voltage output of power supply 20. To this end, UPMI 12 further comprises a digital voltmeter "DVM") 24 disposed so that a digital readout of the power supply voltage is available upon inspection from the outside of the UPMI. In this way, an overload condition due to, for example, a short circuit within the UPMI 12 or power transmitters 10*a*, 10*b*, 10*c*, etc. can be easily detected by the user and appropriate action taken.

The transmitter cables 30*a*, 30*b*, 30*c* etc. are each coupled to UPMI 12 through respective multi-pin connectors 16*a*, 16*b*, 16*c*, etc. In the preferred embodiment each connector has four pins, corresponding to the four conditions in the transmitter cables. The two pressure signal-carrying conductors of each cable are coupled through a terminal board 28 to a master multi-pin connector 18. In the preferred embodiment, master multi-pin connector 18 comprises fifty pins, one pair for each of the respective pressure transmitters 10*a*, 10*b*, 10*c*, etc. Finally, the respective pressure signals are transmitted through to data acquisition system 14 over data acquisition cable 32. Data acquisition cable 32 comprises fifty conductors; two each for the respective signals transmitted by pressure transmitters 10*a*, 10*b*, 10*c*, etc.

From the preceding discussion it is apparent that UPMI 12 provides an efficient means of simultaneously providing power to a number of pressure transmitter 30*a*, 30*b*, 30*c*, etc., and interfacing the same with a data acquisition system 14 so that pressure transmitted can be easily acquired by the data acquisition system 14. In addition, power entry module 22 provides a safe and substantially foolproof means of ensuring that the power supply 20 will be compatible with the available line power.

Figure 2A:
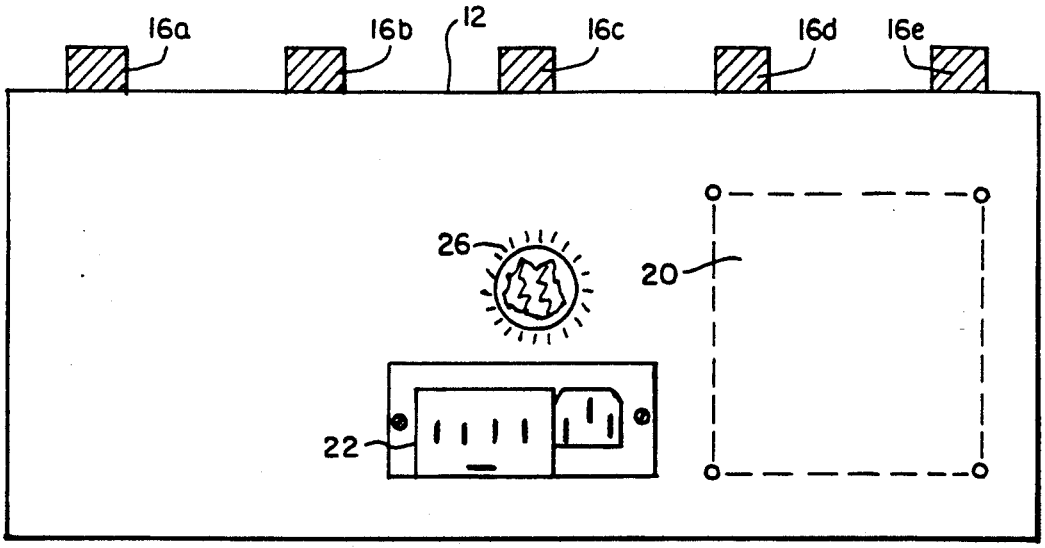
FIG. 2 is a side view of a preferred Universal Pressure Measurement Interface according to the present invention.
FIG. 2B is a simplified top view of the UPMI of FIG. 2A.

Referring now to FIG. 2A, there is depicted a simplified side view of UPMI 12. In addition to multi-pin connectors 16*a*, 16*b*, 16*c*, etc. and Power Entry Module 22 discussed above, there is shown a power light 26 which, when lit, indicates that UPMI 12 is "on."

Figure 2B:
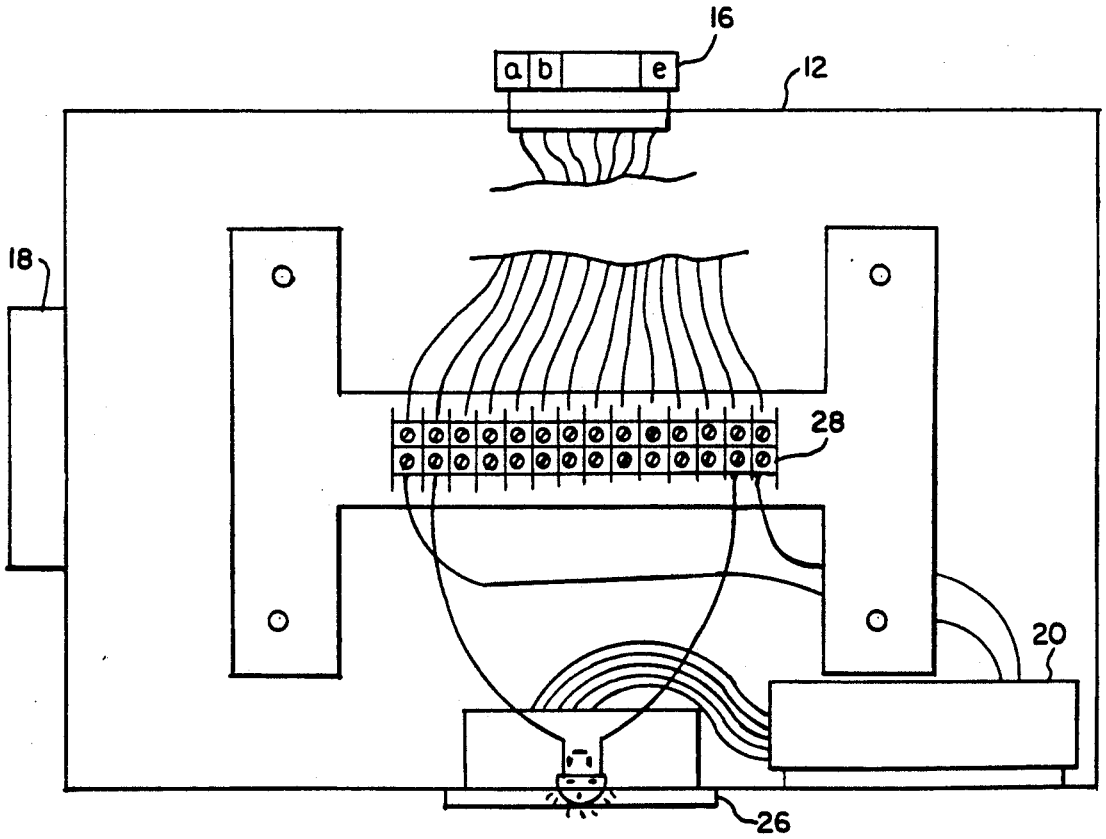

FIG. 2B is a top view showing in a simplified way the wiring of power supply 20, power light 26, master multi-pin connector 18 and terminal board 28. The precise details of the wiring will be apparent to those skilled in the art and will therefore not be discussed herein. FIG. 2B is merely intended to provide the general concept of how the various components are interconnected. Note that the DC voltage is connected through terminal board 28 to each of the multi-pin connectors 16*a*, 16*b*, 16*c*, etc. the transducer signals from 16*a*, etc. may be connected through board 28 to connector 18, or directly to connector 18.

Finally, FIG. 2C is a simplified depiction of the interconnection of Power Entry Module 22 and transformer 34 of power supply 20. As indicated in the drawing, power supply 20 will preferably include voltage adjust means 38 for adjusting the output voltage, and overvoltage means 40 for adjusting the maximum voltage provided to the pressure transmitters 10*a*, 10*b*, 10*c*, etc.

Many variations of the preferred embodiment described herein will be apparent to those skilled in the art. Therefore it is intended that the present invention be defined and limited only by the accompanying claims. While described specifically in relation to pressure transmitter types of transducers, the apparatus of this invention is operable with other types of transducers and signal generating sources. These signal sources may be positioned in a turbine plant system, as indicated in the preferred embodiment, or in other types of operating systems. As used herein, the term "transducer" broadly means "signal source."

I claim:

1. Transducer output measurement interface apparatus for providing an interface between at least one DC powered transducer and a data acquisition system wherein transducer generated data signals are transmitted to the data acquisition system over at least one multi-wire transmitter cable and a data acquisition cable, the interface comprising:

(a) at least one multi-pin connector for coupling signals between the multi-wire cable and said interface apparatus;

(b) master pin connector means for coupling signals between said interface apparatus and the data acquisition system;

(c) a power entry module for receiving an input power signal of approximately 100 to 240 VAC and 50 to 60 Hz;

(d) power supply means for converting the input power to a predefined DC voltage, the DC voltage depending upon the power requirements of the transducer; and (e) means for coupling the DC voltage to the multi-pin connector, thereby providing means for supplying DC power to the transducer.

2. The interface apparatus of claim 1 further comprising:

voltmeter means for providing a measurement of the DC power supply voltage, thereby providing means by which a user can detect an overload condition of the power supply.

3. The interface apparatus of claim 1 wherein the predefined voltage is approximately 15 to 30 V.

4. The interface apparatus of claim 1 wherein the number of multi-pin connectors is 25, thereby enabling the simultaneous coupling of 25 respective transistors to the data acquisition system.

5. The interface apparatus of claim 1 wherein the transducer is a pressure transmitter.

6. The apparatus of claim 1 in combination with a turbine plant system, the apparatus including a plurality of DC powered transducers and means for coupling said transducers to said turbine plant system and arranged to detect parameters of said turbine plant system.

7. A pressure measurement interface for providing an interface between at least one DC powered pressure transmitter for transmitting data signals and a data acquisition system, wherein said data signals are transmitted to the data acquisition system over at least one multi-wire transmitter cable and a data acquisition cable, the interface comprising:

(a) at least one multi-pin connector for coupling signals between the multi-wire cable and the pressure measurement interface;

(b) master pin connector means for coupling signals between the pressure measurement interface and the data acquisition system;

(c) power entry module for receiving an input power signal of approximately 100 to 240 VAC and 50 to 60 Hz;

(d) power supply means for converting the input power to a predefined DC voltage, the DC voltage depending upon the power requirements of the pressure transmitter; and (e) means for coupling the DC voltage to the multi-pin connector, thereby providing means for supplying DC power to the pressure transmitter.

8. Pressure measurement interface of claim 7 further comprising:

voltmeter means for providing a measurement of the DC power supply voltage, thereby providing means by which a user can detect an overload condition of the power supply.

9. Pressure measurement interface of claim 7 wherein the predefined voltage is approximately 15 to 30 V.

10. Pressure measurement interface of claim 7 wherein the number of multi-pin connectors is 25, thereby enabling the simultaneous coupling of 25 pressure transmitters to the data acquisition system.

11. The apparatus of claim 7 in combination with a turbine plant system, the apparatus including a plurality of DC powered transducers and means for coupling said transducers to said turbine plant system and arranged to detect parameters of said turbine plant system.

* * * * *